US008783205B1

(12) United States Patent
Kocher

(10) Patent No.: US 8,783,205 B1
(45) Date of Patent: Jul. 22, 2014

(54) PERSONAL WATERCRAFT SPORT FISHING CONVERSION SYSTEM

(76) Inventor: Jason Kocher, Willoughby, OH (US)

( * ) Notice: Subject to any disclaimer, the term of this patent is extended or adjusted under 35 U.S.C. 154(b) by 17 days.

(21) Appl. No.: 13/566,031

(22) Filed: Aug. 3, 2012

Related U.S. Application Data

(60) Provisional application No. 61/514,603, filed on Aug. 3, 2011.

(51) Int. Cl.
*B63B 17/00* (2006.01)

(52) U.S. Cl.
USPC ..... 114/364; 114/255; 43/21.2

(58) Field of Classification Search
USPC ..... 114/255, 343, 361, 364; 43/21.2
See application file for complete search history.

(56) References Cited

U.S. PATENT DOCUMENTS

| | | | | |
|---|---|---|---|---|
| 4,388,774 | A * | 6/1983 | Thoemke | 43/21.2 |
| 4,869,195 | A * | 9/1989 | Eichfeld | 114/364 |
| 5,673,507 | A * | 10/1997 | Stokes, Jr. | 43/21.2 |
| 6,678,990 | B2 * | 1/2004 | Cox | 114/255 |
| 7,650,847 | B1 * | 1/2010 | Wicks et al. | 114/343 |
| 7,886,677 | B2 * | 2/2011 | Strom | 114/364 |

* cited by examiner

*Primary Examiner* — Lars A Olson
(74) *Attorney, Agent, or Firm* — John D Gugliotta

(57) ABSTRACT

A device for converting an otherwise conventional personal watercraft or into a fishing vessel having an assembly unit releasably secured to said personal watercraft. The assembly unit having rod holders, electronics mounts, and interchangeable attachment clamps specifically designed to mount to the hull of a specific personal watercraft. A stabilizing system is also provided to stabilize the personal watercraft when traveling through the water.

6 Claims, 3 Drawing Sheets

PERSONAL WATERCRAFT SPORT FISHING CONVERSION SYSTEM

RELATED APPLICATIONS

This utility application claims the benefit of U.S. Provisional Application 61/514,603 filed on Aug. 3, 2011.

BACKGROUND OF THE INVENTION

1. Field of the Invention

The present invention relates generally to personal watercraft and accessories thereof, and, more particularly, to a sport fishing conversion system for attachment to and use with a personal watercraft.

2. Description of the Related Art

Each year for the past 10 years, the number of personal watercraft (PWCs) in use in the United States alone has exceeded 1 million. Many of these boaters are also avid fisherman—leading to the inevitable decision, "do I buy a nice fishing boat and sell my jetski, or do I keep the jetski and have less of a fishing boat?"

Consequently, the need exists for a system and method to convert a jetski into a fishing boat on demand.

SUMMARY OF THE INVENTION

It is therefore an object of the present invention to provide a system that adapts to a personal watercraft to accommodate the storage and use of various accessories used in fishing.

Briefly described according to a general embodiment of the present invention, a personal watercraft sport fishing conversion system is provided that incorporates an innovative accessory mounting system that allows a user to add up to 4 rod holders, a GPS depth finder, stabilizers, and a cooler, among other things, to an otherwise conventional personal watercraft. The mounting system is easily attachable and removable, without any tools, holes, or damage to the watercraft.

In an alternate embodiment, a tactical package is provided for use with law enforcement in which the mounting system is compatibility with standard tactical accessories, as well as built in spot lights, flood lights, signaling light bar, and secure storage. Armor and weaponry attachments are provided as options.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
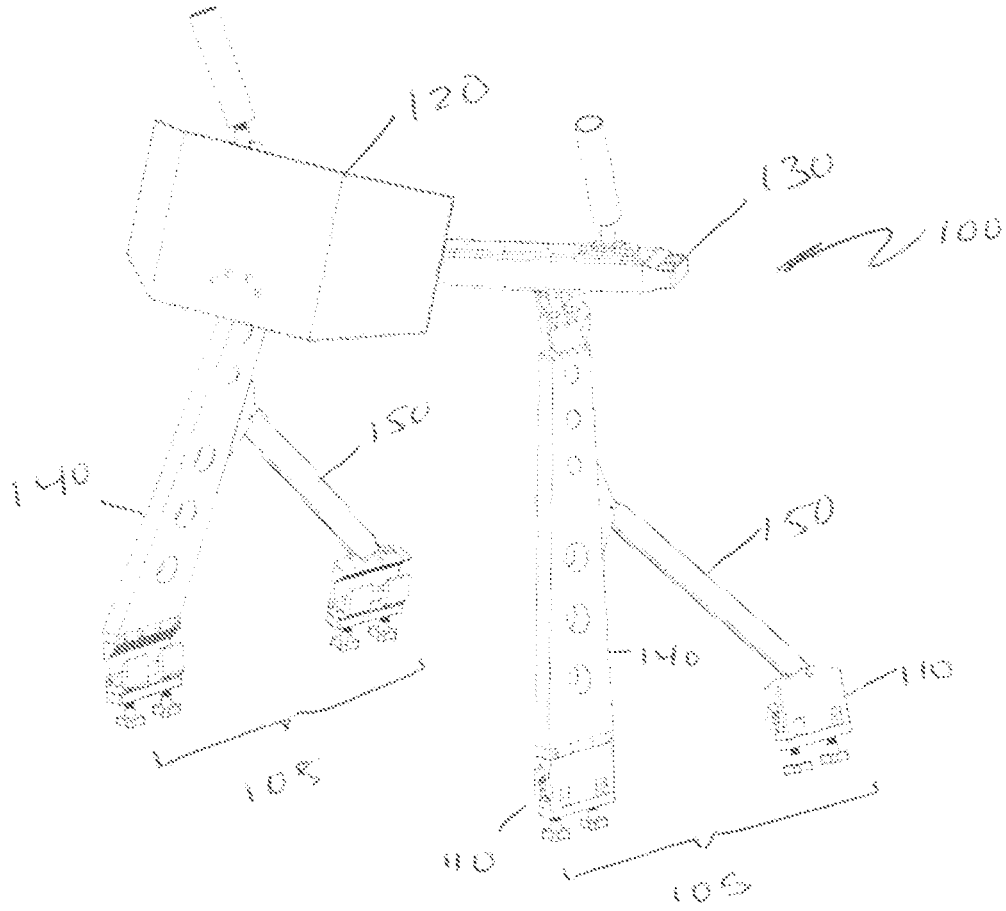
FIG. 1 is a perspective view of a personal watercraft sport fishing conversion system is shown according to the preferred embodiment of the present invention.

Referring now to FIG. 1, a perspective view of an overall assembly 100 for the front accessory mount is shown. Formed of rugged stainless steel, the structure has been designed to handle repeated abuse from waves, fishing rod strain, and transportation. The assembly 100 features at least two attachment ends 105 and at least two attachment clamps 110 (as shown in greater detail in FIG. 2) hollow body welded aluminum support legs 140, machined aluminum tie downs 150, and a Lexan™ front splash guard 120 designed to protect sensitive GPS and fishing electronics. It is anticipated that an anodized or powder coat finish can be applied for additional corrosion protection. As illustrated in this diagram, a rod holder 130 and multiple electronics may be attached to the top surface, without interfering with the front display or side mirrors of the watercraft. The rod holder 130 of FIG. 1 is shown capable of holding four fishing rods, however other multiples are available and anticipated. Additionally, the license numbers and watercraft sticker on the side of the jetski are not obstructed in any way. Simply route the power and transducer wires from inside the jetski up through the steering column splash 120 guard, and connect to the back of the electronic device.

Figure 2:
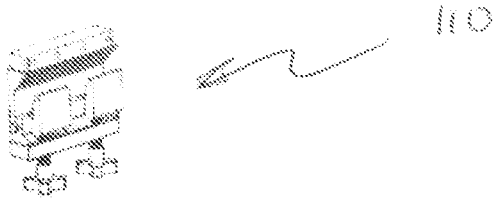
FIG. 2 is a perspective view of an attachment clamp for use therewith.
Figure 3:
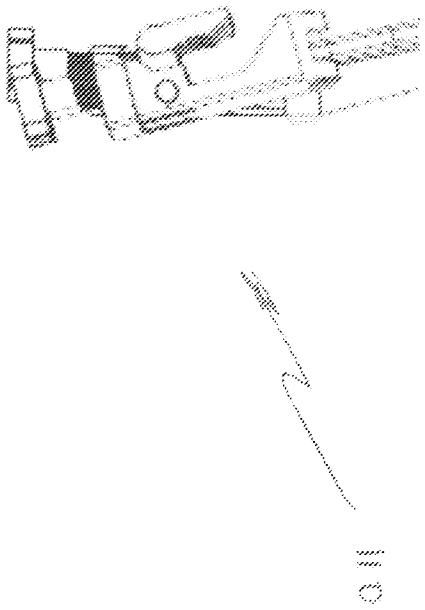
FIG. 3 is a side view showing the profile of the attachment clamp of FIG. 2.

The attachment clamp 110 of FIGS. 2 and 3 is the core of the present design. This clamping mechanism is designed to support the entire weight of the front accessory mounting system.

The attachment clamp 110 having an attachment body 300, receiving slot 310, and securing means 320. The attachment body 300 securely mates with the support legs 140 of the assembly 100.

The attachment body 300 securely mates with the support legs 140, yet this secured mating is releasable. The attachment body 300 may be interchanged with another attachement body 300 having an alternately designed receiving slot 310.

The receiving slot 310 is specifically design to receive the hull of an otherwise convential personal watercraft. As shown in FIG. 3 from the side view, the profile of the clamp 110 can be seen. The receiving slot 310 of FIG. 3 is designed for the Yamaha WaveRunner™. Additional clamps 110 are anticipated as being designed for adaptation to any particular personal watercraft models, and will be interchangeable with the rest of the parts in the system.

The securing means 320 must secure the assembly 100 to the personal watercraft. It is anticipated that the securing means 320 will be releaseable, through the use of threaded securing means. However, other securing means are anticipated. The assembly 100 and securing means 320 must also support the device through waves, trolling rod strain, and trailer transportation of the personal watercraft to and from its storage location and point of use.

Figure 4:
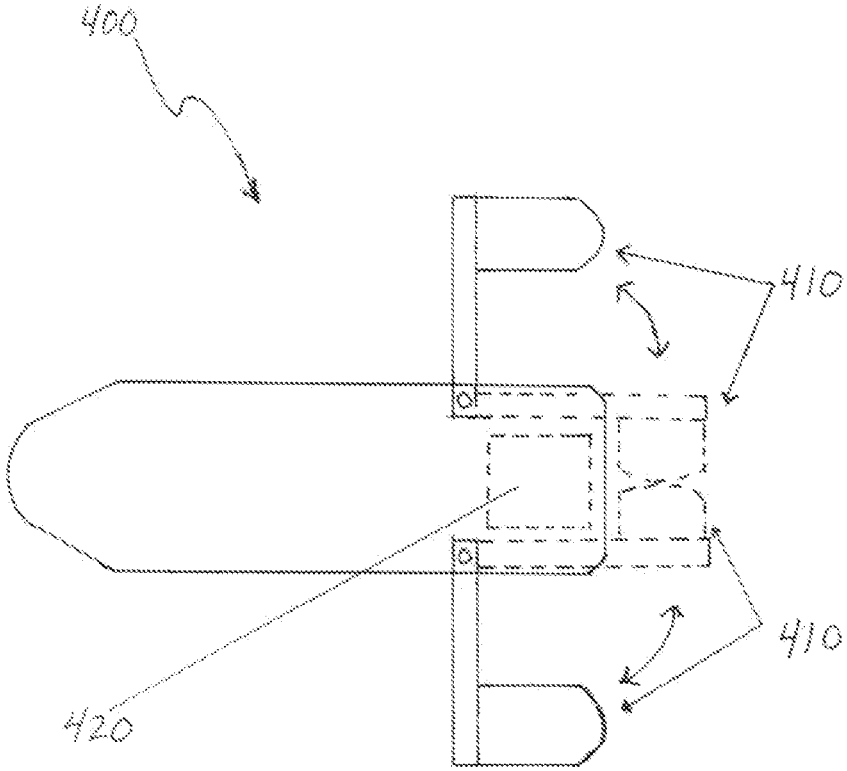
FIG. 4 is a top view of both a stabilizer system for use therewith and rear storage assembly for use therewith.

Referring now to FIG. 4, an stabilizer system 400 is shown as an optional attachment in which pivotable stabilizer arms 410 are provided that can be affixed to the sides of the watercraft and used to reconfigure the hull as a miniature catamaran. This design adds stability when anchored or drift fishing. Some jetski models are inherently more stable than others, but with the stabilizers affixed and extended, every model of jetski becomes as stable as a small fishing boat. When it's time to head back to shore, simply stow the stabilizers by collapsing them inward.

Further referring to FIG. 4, a rear storage assembly 420 is shown. Such an assembly allows attachment of a full cooler, commonly used to store any freshly caught game fish. The rear storage assembly clamps to the jetski and positions the cooler in the best possible location—slightly aft of the center of gravity, on the rear swim platform of the jetski. This location is the most stable when transporting heavy items through rough waves.

2. Operation of the Preferred Embodiment

In operation, the present invention allows a personal watercraft to be converted to a sport fishing craft by attachment of an accessory mounting system that allows a user to add up to 4 rod holders, a GPS depth finder, stabilizers, and a cooler, among other things, to an otherwise conventional personal watercraft. The mounting system is easily attachable and removable, without any tools.

As described above, a preferred embodiment, as anticipated at the time of filing, is identified and described as exemplary of the teachings of the present invention. However, the disclosure is not intended to be narrowly construed by this exemplary embodiment, as one skilled in the art would know that the operational and functional equivalent of many of the components, systems, steps and processes taught herein could be modified or replaced by equivalent components, systems, steps and processes and still remain within the spirit and teachings of the present invention. By way of example, and not as a limitation, the present system allows for the design and conjunctive use of a number of accessories designed to mount on the accessory mounting system. Ruggedized tackle boxes, minnow saver shock dampening live wells for bait transportation, and anchoring systems are all anticipated.

The foregoing descriptions of specific embodiments of the present invention are presented for purposes of illustration and description. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated.

Having thus described the invention what is claimed as new and desired to be secured by Letters Patent is as follows:

1. A device for converting a personal watercraft to a sport fishing system comprising:

an assembly unit having at least two attachment ends wherein said assembly unit comprises:

at least two hollow legs;

a plurality of tie downs;

a splash guard, whereby said splash guard protects an electronic instrument panel;

at least one fishing rod holder;

at least one mounting area, whereby said area receives and securely retains an insulated cooler; and each attachment end having at least one attachment clamp wherein said attachment clamp securely mates said device to said personal watercraft and supports said entire assembly unit.

2. The device of claim 1, wherein said fishing rod holder comprises:

four independent fishing rod mounts, capable of retaining four fishing rods at one time.

3. The device of claim 1, further comprising a stabilizer system, said stabilizer system comprising:

at least two pivotable stabilizer arms, whereby when deployed in an extended stabilizing position, said stabilizer arms enter the water on the respective port and starboard sides of said personal watercraft to stabilize said personal watercraft.

4. The pivotable stabilizer arms of claim 3, where said pivotable stabilizer arms are detachable from the assembly unit.

5. The stabilizer system of claim 3, further comprising a rear storage assembly;

said rear storage assembly rear houses said insulative cooler, aft of a center of gravity of and on a rear swim platform of a jetski providing a stable base for transporting heavy items through rough waves.

6. The device of claim 1, wherein said attachment clamps comprise a body, a receiving slot and a securing means, whereby said attachment clamp is engineered and designed to securely fit with a specific manufacturer's model of personal watercraft.

* * * * *